US005852908A

United States Patent [19]

Nankin

[11] Patent Number: 5,852,908

[45] Date of Patent: Dec. 29, 1998

[54] STRUCTURAL BEAM AND WEB

[75] Inventor: Morris Nankin, Victoria, Australia

[73] Assignee: Techtruss Holdings Pty. Ltd., Victoria, Australia

[21] Appl. No.: 776,789

[22] PCT Filed: Aug. 14, 1995

[86] PCT No.: PCT/AU95/00494

§ 371 Date: Feb. 11, 1997

§ 102(e) Date: Feb. 11, 1997

[87] PCT Pub. No.: WO96/05385

PCT Pub. Date: Feb. 22, 1996

[30] Foreign Application Priority Data

Aug. 12, 1994 [AU] Australia ..... PM 7451
Feb. 6, 1995 [AU] Australia ..... PN 0909

[51] Int. Cl.[6] ..... E04L 3/292

[52] U.S. Cl. ..... 52/729.2; 52/729.3; 52/729.4; 52/690; 52/696; 29/897.35

[58] Field of Search ..... 52/737.3, 729.3, 52/729.4, 729.2, 690, 696; 29/897.35

[56] References Cited

U.S. PATENT DOCUMENTS 3,025,577 3/1962 Jureit .
3,298,151 1/1967 Jureit .
3,503,173 3/1970 Jureit .
3,708,942 1/1973 Leonard .
4,078,352 3/1978 Knowles .
4,207,719 6/1980 Knowles .
4,348,850 9/1982 Reeder et al. .
4,523,419 6/1985 Palacio et al. .
5,524,410 6/1996 Menchetti ..... 52/729.2

FOREIGN PATENT DOCUMENTS 0 282 424 9/1988 European Pat. Off. .
1 572 354 11/1976 United Kingdom .
2 253 223 9/1992 United Kingdom .
89/11011 11/1989 WIPO .
93/11323 6/1993 WIPO .
94/23149 10/1994 WIPO .

*Primary Examiner*—Christopher Kent
*Attorney, Agent, or Firm*—Foley & Lardner

[57] ABSTRACT

A composite beam having timber top and bottom chords and a pressed sheet metal web. The web has a series of stiffened panels arranged at intervals therealong, the panels being joined by a continuous strip along at least one edge of the web. End studs are employed. The components of the beam are fixed in place by nails which pass through the chords, the studs, and the web. Various forms of web are disclosed together with apparatus and methods for assembling the beams.

8 Claims, 8 Drawing Sheets

STRUCTURAL BEAM AND WEB

TECHNICAL FIELD

This invention relates to composite steel-and-timber structural beams and to steel webs for use in such beams. It also concerns methods of forming such beams and to apparatus for use in such methods. The beams with which this invention is concerned find use in supporting spans up to eight metres in domestic and 'low-rise' light commercial buildings. They may be used as bearers, joists, lintels and the like.

BACKGROUND TO THE INVENTION

Composite steel and timber beams have the advantage of being cheaper than structurally equivalent beams formed wholly from timber and lighter and more easily employed in timber structures than steel beams. Such composite beams typically have timber chords and steel webs or braces secured to the timber using integral spikes struck from the steel. It is desirable for such composite beams to be easily manufactured by local roof-truss makers and builders suppliers who service the domestic and light construction industry. It is also desirable for such beams to have openings pre-formed therein to accommodate wiring and piping.

Many truss-like composite beams have been proposed using press-formed, ribbed or flat, rectangular or V-shape spiked connector plates for fixing the timber chords together. Examples are disclosed in U.S. Pat. Nos. 3,025,577, 3,298,151, 3,503,173, 4,078,352, 4,207,719, 4,348,850 and 4,523,419, and UK patent No. 1,572,354. Thus, U.S. Pat. No. 4,523,419 discloses the use of multiple rib-stiffened rectangular spiked plates which are pressed, at spaced intervals, onto the outside faces of a pair of timber chords to create a beam. The stiffening ribs in the plates are deeper than the spikes so that they assist in locating the chords in correct spaced relationship while the plates are pressed home to drive the spikes into the timber. Similarly, UK patent 1,572,354 discloses the use of multiple V-shape spiked braces which are also spaced out along timber chords. While such beams provide plenty of openings for piping and can be fabricated by local truss makers, they require high-grade and continuous timber chords, are laborious to assemble (since there are so many components), difficult to manufacture straight and difficult to handle because of their lateral flexibility.

In my Australian patent No. 650614, I disclosed a variety of beams having timber chords and continuous steel webs in which the webs are roll-formed and punched to produce integral spikes along their upper and lower edges and, if desired, to provide access holes. The webs are attached to the chords by pressing the spikes into the timber chords. Since the webs have continuous upper and lower edges, low-grade timber can be used for the chords. However, few truss-makers or builders suppliers can afford the necessary roll-former, punch and press, so such beams are now only made in central locations.

OBJECTIVES OF THE INVENTION

The general objective of this invention is to provide improved composite beams, improved webs for use in such beams and improved beam fabrication methods and apparatus. It is desirable that such beams be easy to manufacture with few components and low-grade timber, while providing ready access for piping and the like.

OUTLINE OF INVENTION

The present invention is based upon the realisation that an I-form beam with a central sheet-metal web and timber chords can be readily fabricated using nails (preferably from nail-guns), instead of presses to form a coherent and structurally-sound beam. Without the need for spiked steel components, assembly is greatly simplified. Moreover, it was appreciated that, if the web were to have alternating ribbed and plain panels, the ribbed panels would provide the necessary structural stiffness for the beam while the plain panels would give the web sufficient flexibility for it to be supplied to beam-fabricators in coil-form. Furthermore, large access holes could be formed in the plain panels without compromising the strength of the beam, provided at least one continuous edge (tension-strip) was retained.

Conveniently, the web may be of castellated form so that two webs can be produced from a single blank strip, each having a continuous tension-strip along one edge (which will be at the bottom of the beam) and castellations along the other (the top) edge. In that event, the plain panels are essentially reduced to the portion of the tension strip lying between the stiffened panels. Castellated webs having substantially rectangular (including square) panels are generally most suitable, but panels of triangular (upright or inverted) form may also be employed. It is desirable to include a generous radius between each side edge of each stiffened panel and the tension-strip(s) for reinforcement.

Alternatively, the web may be formed with continuous top and bottom tension strips between which the alternate stiffened and the blank (or holed) panels or spaces are located. The tension strip(s) may be integral with the panels or the web may be assembled from separate tension strip(s) and discrete ribbed panels arranged at spaced intervals. The strip(s) and panels may be fixed together (as by spot-welding) and supplied as a coiled web, or they maybe supplied separately and fixed together (with the timber chords) when the beam is nailed.

The ribs of the stiffened panels of the web are preferably formed so that they will be orthogonal to the chords of the finished beam and so that their ends are aligned in such a manner as to locate the upper and lower chords (on each side of the web) in spaced relation to one another. For this purpose, adjacent ribs are preferably pressed from opposite sides of the web and each end of each rib is cut from the body of the web so as to form a well-defined shoulder to bear against the adjacent timber chord.

To assemble a beam using such strip-form webs, all that is required is to lay a pair of timber chord halves on a bench or in a horizontal jig so that they are coplanar and in parallel spaced relationship with one another, lay the desired length of web on top of the chord halves so that the ends of the ribs of the web contact and separate the chord halves, lay another pair of chord halves on top of the web so that they are similarly aligned and separated, hold or clamp the components together in alignment, and finally, nail into and along the upper chord halves to secure the components permanently together (the nails penetrating through the upper chord halves, through the material of the web and into the lower chord halves). It is also envisaged that the web may be arranged in a vertical rather than a horizontal plane while the chord halves are arranged and clamped in place, the nails then being driven horizontally through the web and the chords. This has the advantage of allowing nails to be driven from both sides of the beam.

The assembly of a piece-form web can follow essentially the same sequence except that the ribbed plates will be laid out along the first pair of chord halves and then the tension strip(s) will be laid over the plates and the chord half(ves) before the second pair of chord halves are laid on top, clamped and assembled.

As already indicated the web can be supplied flat in modular lengths or it may be coiled and supplied in coil form. If coiled and of the castellated form, it may be convenient to supply the intermeshing and castellated web-halves as a coiled unit, the two castellated webs being attached to one another by thin ties or tabs of the uncut material of the strip so that they can be readily separated, allowing one web to be uncoiled without having to uncoil the other. A (single-web or double-web) coil can be transported readily with or without supporting reels and can be mounted on suitable reels for uncoiling at the site where the beams are to be fabricated. In that event, it will be convenient to fit straightening rolls or guides to straighten the web as it is pulled from the coil and drawn into or along the jig for forming the beam.

From another aspect, the invention comprises a load-bearing panel formed from sheet-metal for use as part of the vertical web of an I-beam having top and bottom chords formed from lengths of timber, said panel having: substantially flat horizontally-extending upper and lower faces on each side thereof adapted for interposition between pairs of top and bottom chord-elements, each face having a depth approximating that of the respective chord-elements, and a plurality of vertical stiffening ribs pressed into or struck from the portion of the panel intermediate between said upper and lower faces so that at least one rib protrudes from each side of the panel and so that the bottoms of the ribs terminate at the top of said lower faces and the tops of the ridges terminate at the bottom of said lower faces, the ribs thereby being adapted to vertically locate the top and bottom chords of a beam with respect to each other.

From another aspect, the invention may comprise a composite I-beam including a central metal web of the type indicated above and timber chords elements along both sides and both edges of the web, the opposing chords elements along one edge of the web being nailed together by nails passing through the web to form a complete top or bottom chord.

From yet another aspect, the invention comprises a method of constructing a structural beam including the steps of: arranging a first pair of timber half-chord elements in parallel, spaced and coplanar relationship, laying a web of the type indicated above against the chord elements so that the unstiffened portions of sides of the web lie upon first pair of half-chord elements, placing a second pair of half-chord elements in a similar manner against the other side of the web opposite the first pair of half-chord elements and nailing the opposing chord elements together through said unstiffened portions of the sides of the web to complete the top and bottom chords of the beam and, indeed, to complete the beam itself.

The method may include the step (before nailing) of moving each pair of chord elements toward one another while in contact with the web until their inner faces abut with the ends of the stiffening ribs of the web, so that the spacing of the upper and lower chords is positively determine before nailing. It may also include the step of drawing a length of web from a coil linearly over the first pair of half-chord elements so that it lies thereon. Further, the method may include mechanically supporting at least one nail gun in juxtaposition with a chord element and drawing it along said element while driving nails therein at regular intervals. Alternatively, the method may include feeding an assembled beam past at least one fixed nail-gun and operating the gun(s) to drive nails through one or both chords at regular intervals therealong.

From yet another aspect, the invention may comprise apparatus for forming composite beams, the apparatus including a linear jig for holding a pair of timber chords in spaced parallel and coplanar relationship, means for mounting a coil of strip-form web so that a length of web may pulled (and uncoiled) therefrom and laid upon or against a pair of chord elements held in said jig, and clamp means for clamping a second pair of chords against the web and the first pair of chords while providing access to allow the opposing chord elements to be nailed together through the web.

DESCRIPTION OF EXAMPLES

Having broadly portrayed the nature of the present invention, particular embodiments will now be described by way of example and illustration only. In the following description, reference will be made to the accompanying drawings in which:

FIG. 1 is a perspective view of a composite I-beam, with portions of chord broken away, formed in accordance with this invention.

FIGS. 2A, B and C are perspective views of alternative webs which may be employed in the beam of FIG. 1.

FIGS. 3A, B and C are side elevations of steel strip-blanks perspective illustrating some different ways in which a pair of identical castellated webs may be cut from such strips without waste.

FIG. 4 is a perspective view of a second example of a beam formed in accordance with this invention.

FIGS. 5A, B and C illustrate other alternative forms of web suitable for use in composite beams envisaged herein.

FIGS. 6A and B are, respectively, a diagrammatic side and an end elevation of a beam-jig apparatus suitable for use in assembling the beams of this invention.

Figure 1:
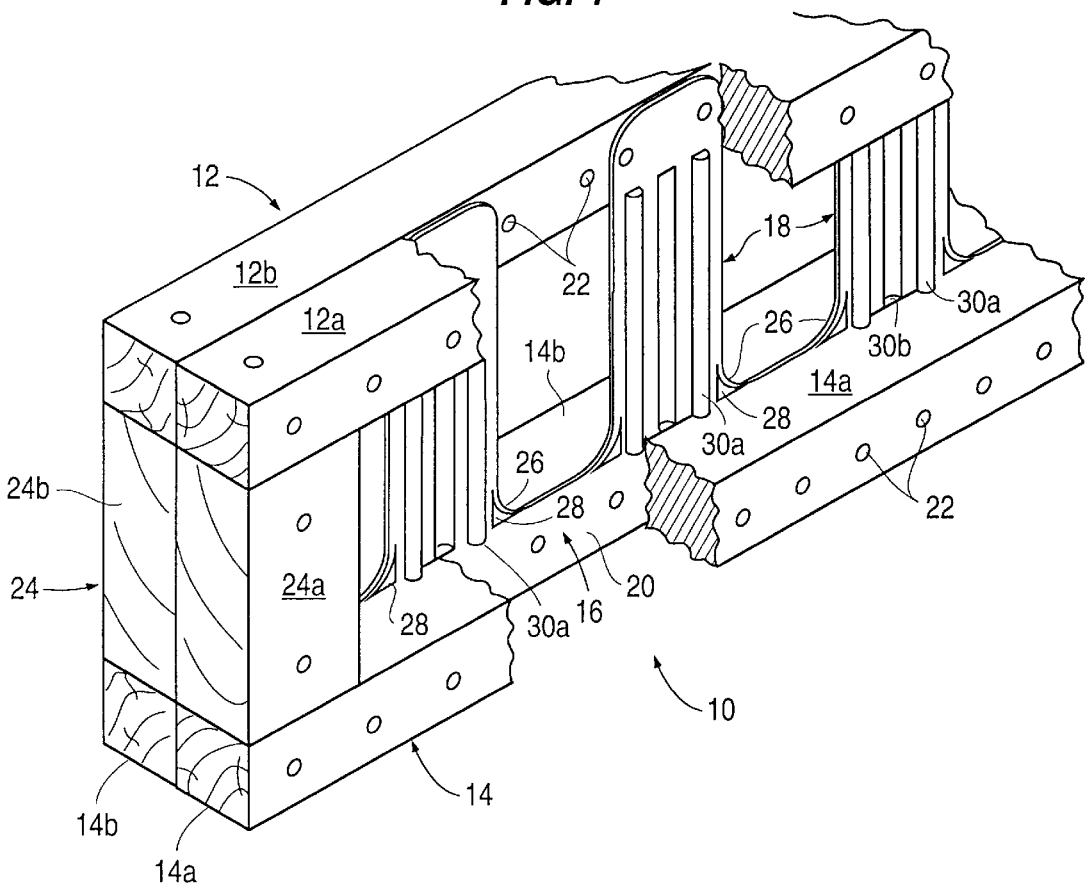

FIG. 1 illustrates an I-beam 10 which will serve to exemplify various aspects of this invention. It basically comprises split top and bottom chords 12 and 14 formed from timber (top chord 12 comprising front and rear chord-halves or elements 12*a* and 12*b* and bottom chord 14 having front and rear elements 14*a* and 14*b*) and a sheet-metal web 16, comprising spaced vertical rib-stiffened web-panels 18 and a longitudinal bottom tension strip 20, sandwiched between the elements of chords 12 and 14 and secured in place by nails 22. Beam 10 is terminated at each end by an end-stud 24 comprising—in this example—front and back half-studs 24*a* and 24*b* nailed together and to the respective chord elements. Alternatively, the end-stud halves may be formed by metal plates nailed to the respective chord halves or incorporating integral spikes which are driven into the chord elements.

Figure 2A:
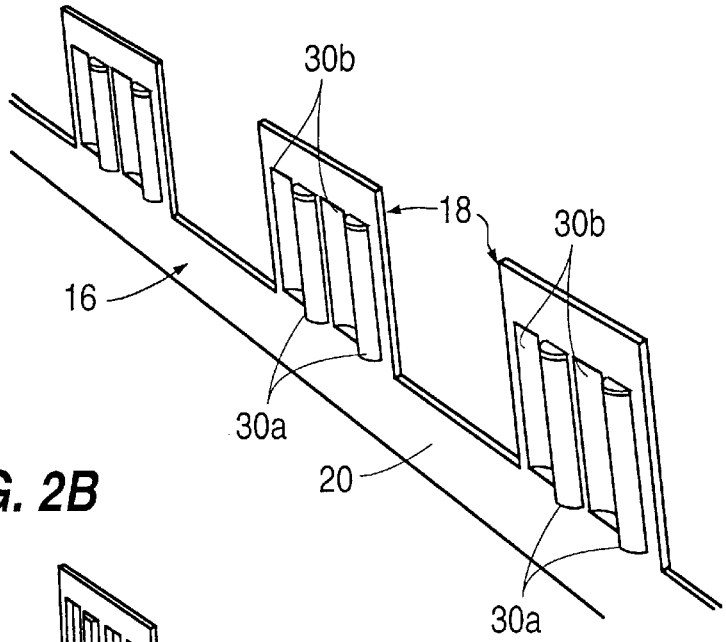

Web 16 is in the form of a castellated strip with generous fillets 26 between the junction between panels 18 and tension-strip 20, each fillet having a triangular stiffening indentation 28 to further strengthen this portion of web 16. As FIG. 2A illustrates this general type of web (which differs only in that fillets 26 are omitted and four ribs are employed per panel instead of 3), the same reference numerals will be used as for FIG. 1. Each rib-stiffened panel 16 has forwardly projecting stiffening ribs 30*a* and rearwardly projecting ribs 30*b* pressed therefrom, the ribs being of a semi-circular section in this case. Both ends of all ribs are cut from the material of their panels 18, the bottom ends being aligned along the web with the top of tension-strip 20 (and, therefore the top of lower chord 14), and the top ends of the ribs being aligned with the bottom face of upper chord 12.

Figure 2B:
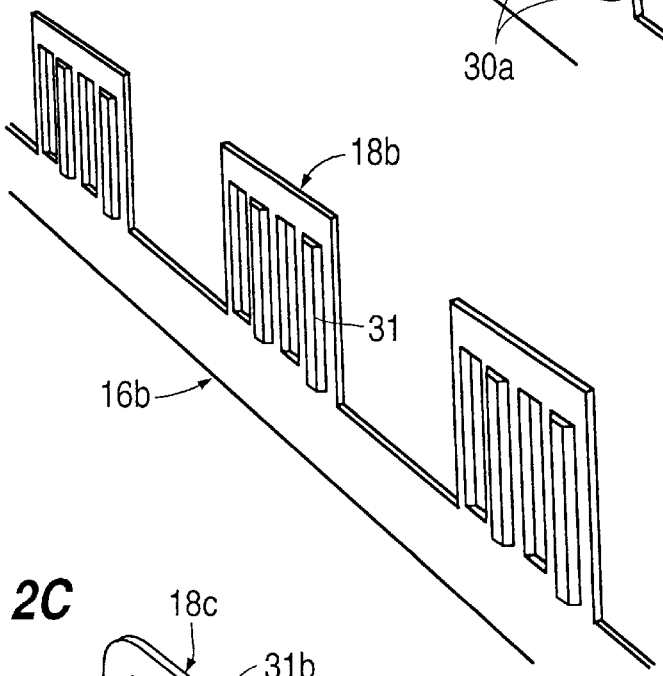
Figure 2C:
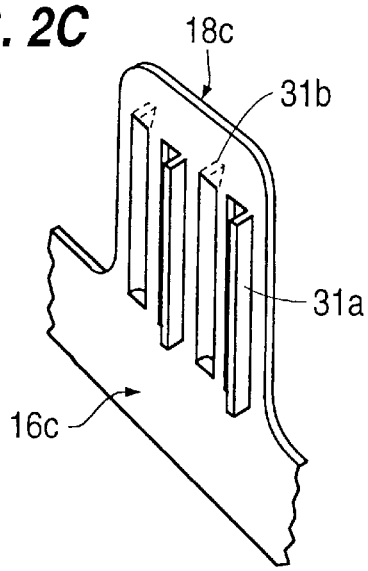

The aligned ends of ribs 30 thus form a pair of shelves, or aligned rows of stops, against which the chord-elements can be abutted to assist in their correct location during assembly of the beam. This desirable effect can be achieved with a variety of different stiffeners. FIG. 2B shows a web 16*b* with similar stiffening ribs 31 in panels 18*b*, but in this case, the ribs are of trapezoidal section. The web 16*c* of FIG. 2C includes a similar shape of stiffened panel 18*c*, but in this case ribs 31*a* are punched-out as vertical flaps from the material of the web.

Figure 3A:
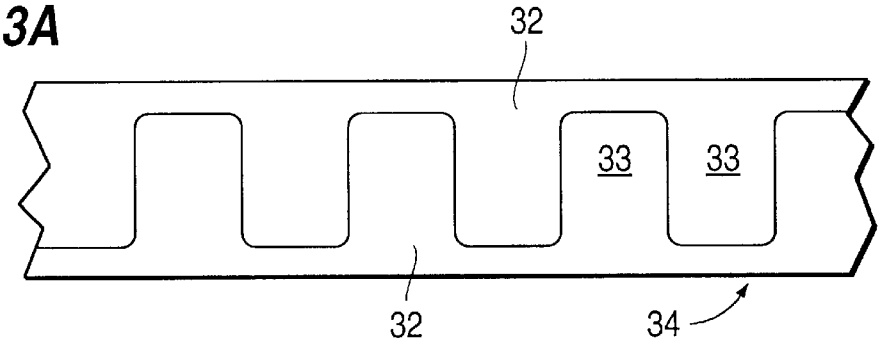
Figure 3B:
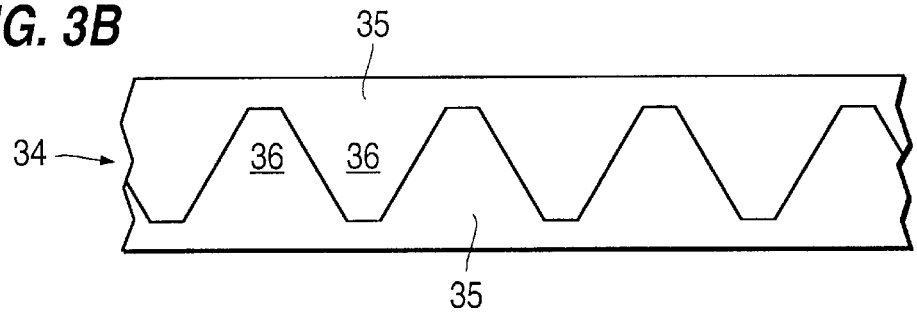
Figure 3C:
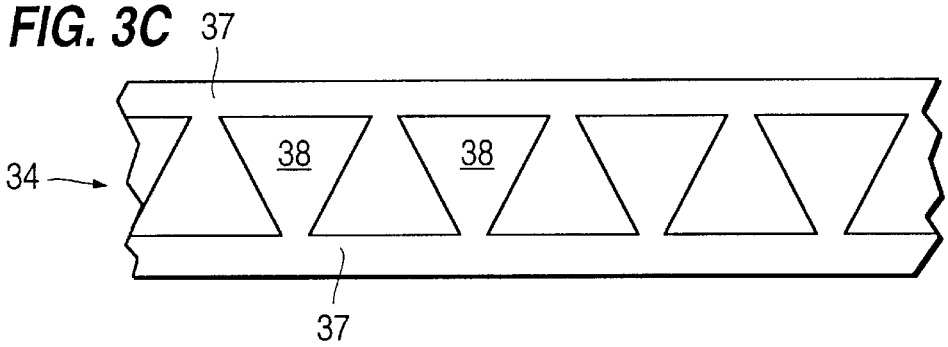

It will be readily appreciated that two castellated webs of the types shown in FIGS. 1 and 2 may be pressed from a single strip-blank in a single pass without waste. Other forms of castellated webs may also be produced in this manner. FIG. 3A diagrammatically indicates the way two webs 32 with rectangular-form panels 33 may be cut from a strip 34. FIG. 3B similarly shows how two webs 35 with 'upright' triangular-form panels 36 may be cut from the strip 34, while FIG. 3C shows how webs 37 with 'inverted' triangular-form panels 38 may be cut from the strip 34. For the sake of clarity, the stiffening of panels 33, 36 and 38 is not shown.

Figure 4:
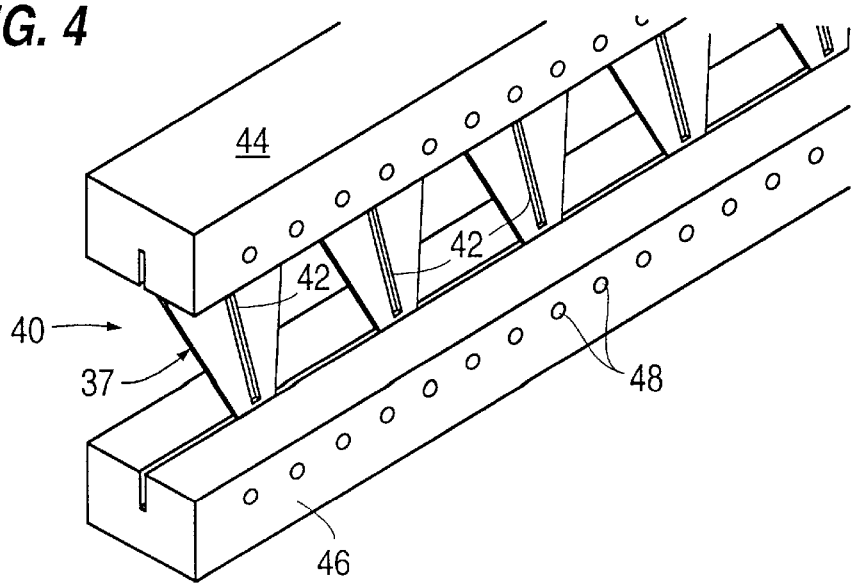

FIG. 4 illustrates a beam 40 employing the inverted triangular web 37 of FIG. 3C, with stiffening ribs 42. In this case, however, the top and bottom cords 44 and 46 are slotted rather than completely split to take the web. As before, the chords are fixed to the web by nails 48.

Figure 5A:
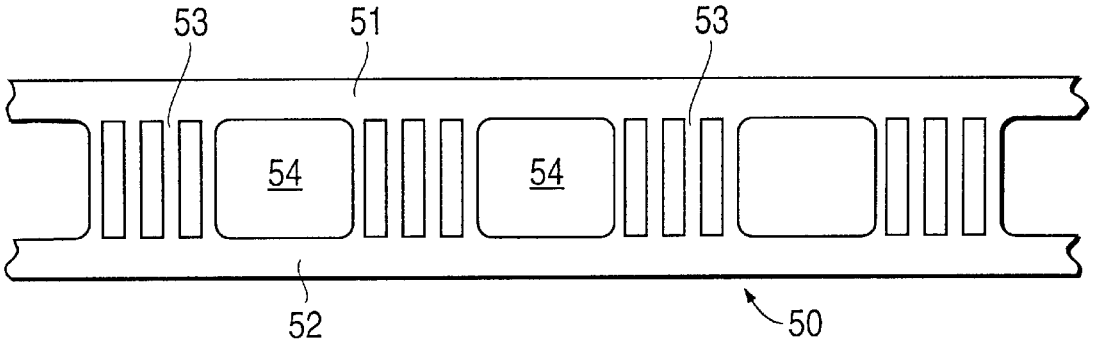
Figure 5B:
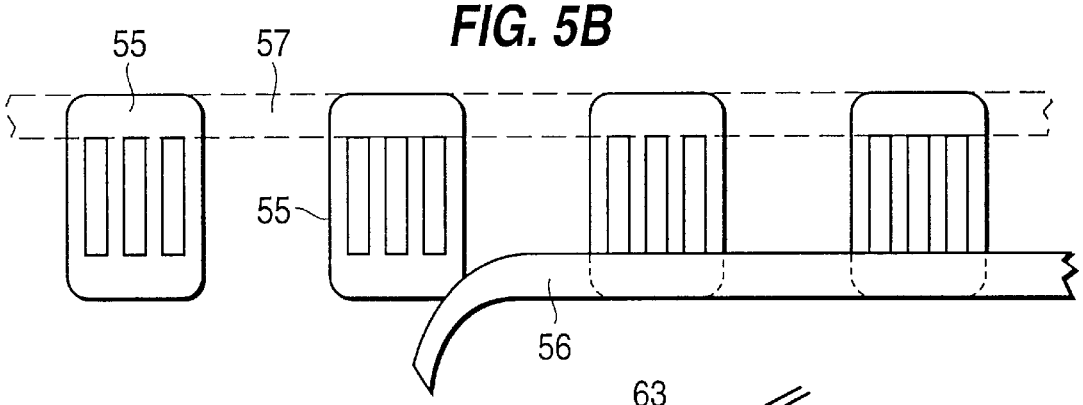
Figure 5C:
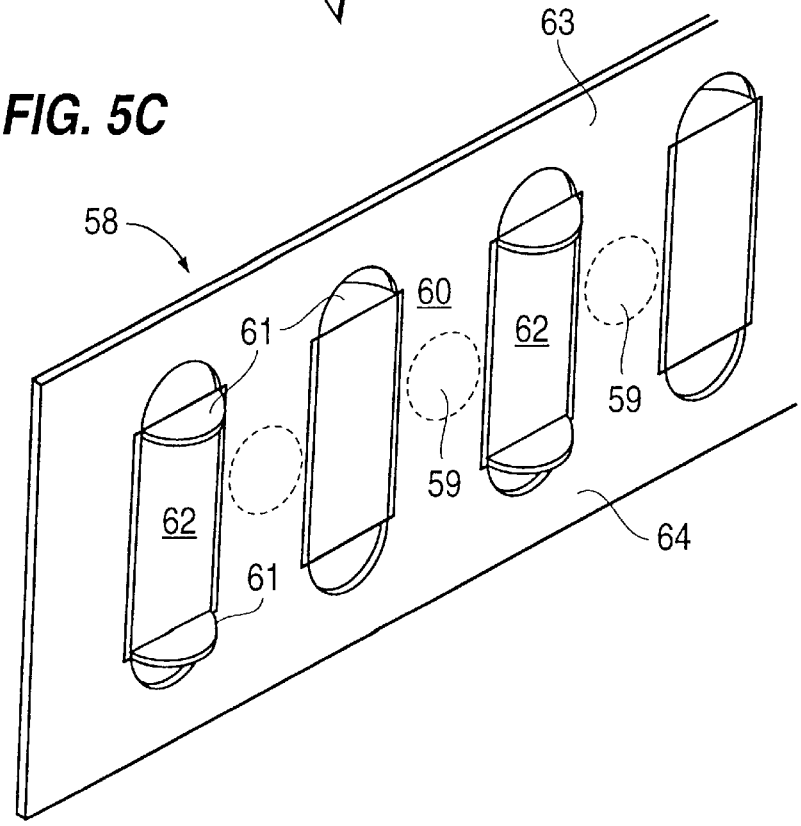

FIGS. 5A–C show still further variants for the web. That of FIG. 5A is a non-castellated web (50) which has integral top and bottom tension-strips 51 and 52, allowing beams with this web to be mounted either way up. The stiffened panels 53 are alternated along the web with openings 54. FIG. 5B shows a fabricated web formed from separate stiffened panels 55 spaced along the web and joined together (as by spot-welding) by a separate bottom tension strip 56 and, optionally, by a top tension strip 57 shown in broken lines. Panels 55 and tension-strip 56/57 need not be assembled to form the web prior to beam fabrication as they can be laid-up on a pair of chord-elements and then joined by the nails which fix the chord elements together. This allows the gaps between panels 55 to be tailored to the length of the span and the access for piping required. While such webs also avoid the waste of material associated with the pressing of web 50, the penalty of fabrication labour must be accepted. Nevertheless, both the webs of FIGS. 5A and 5B are readily coiled.

The web 58 of FIG. 5C is an example of one which does not have any holes for piping or wiring, but provision for such holes can be made by scoring circles 59 in the unstiffened panels 60. In this example, lugs 61 are stamped and folded outwards from each end of the stiffened panels 62 to form the stops for the location of the chord elements. While such a web can be readily coiled, lugs 61 are struck from the upper and lower tension strips 63 and 64 so reducing the load which could otherwise be carried by the beam.

Figure 6A:
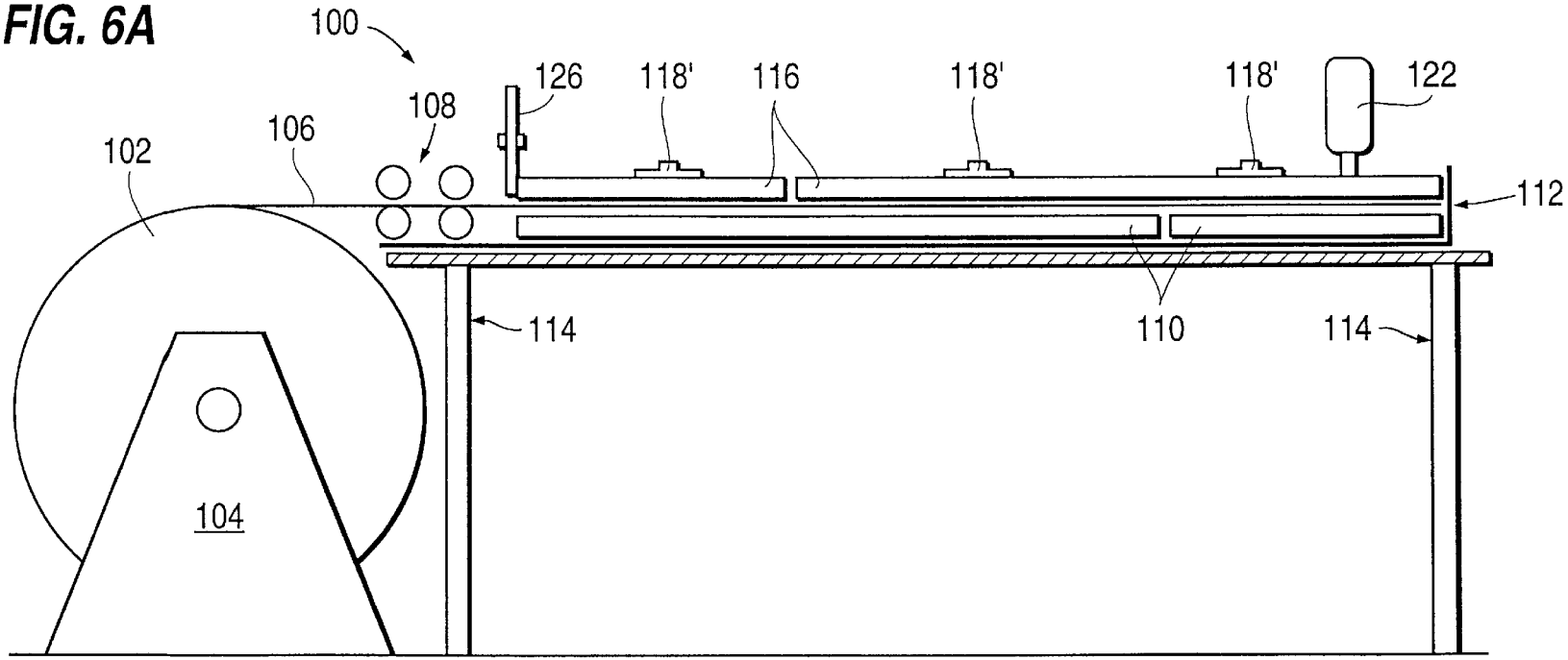
Figure 6B:
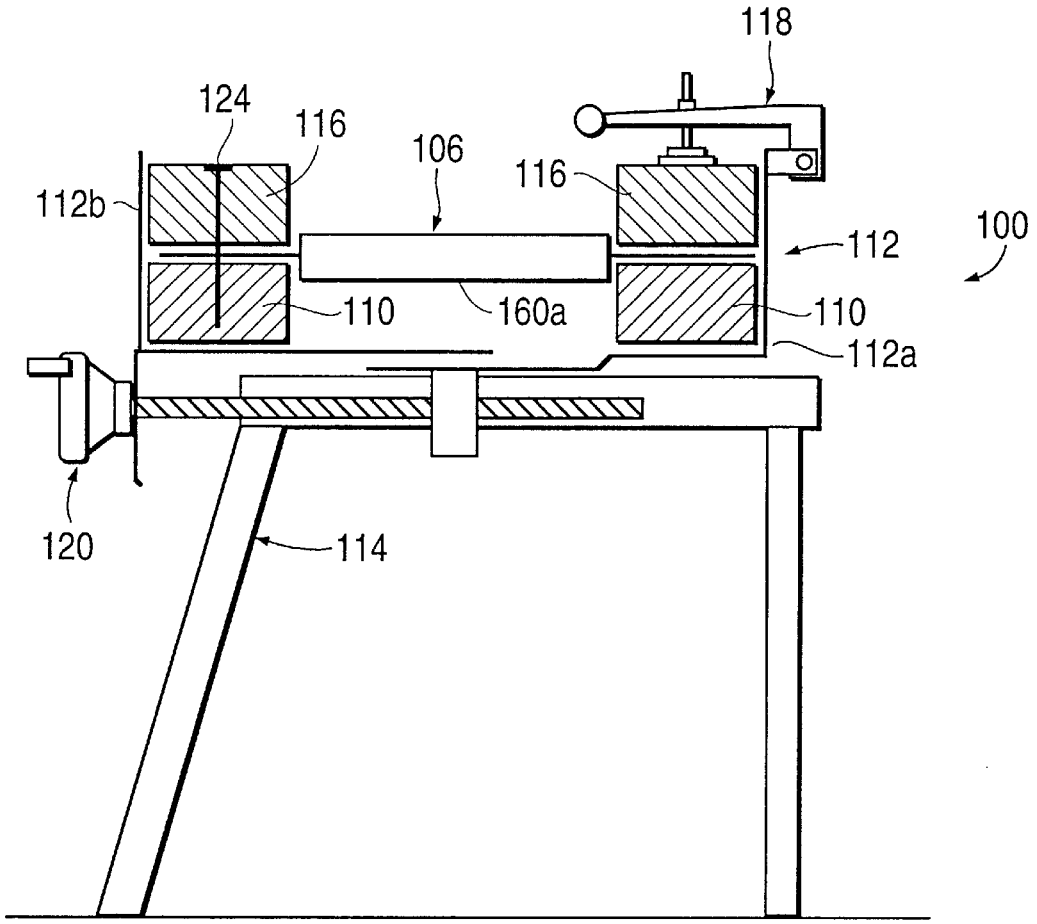

One form of apparatus (100) for forming beams such as that illustrated in FIG. 1 is shown in FIGS. 6A and 6B. Here a coiled double-web 102 is supported on a stand 104 so that a single web 106 can be pulled off the coil, through straightening rolls 108 and laid on a pair of timber chord-elements 110 resting in an open clamping-jig 112 that is supported on a table 114. The second pair of chord elements 116 are then laid in place on top of the edges of web 106 and clamped down onto web 106 and chord elements 110 by spring-clamps 118. For clarity, spring-clamps 118 are shown on one side of the clamping-jig only (though they will usually be used on both sides) and, in FIG. 6A, they are shown indicatively at 118'.

Clamping jig 122 is formed in two longitudinal halves, a fixed half 112*a* and a moving half 112*b* which can be moved together or apart by hand-screws 120. After spring-clamps 118 have been applied, hand-screws 120 are operated to move clamp-half 112*b* toward clamp-half 112*a* and force the members of each pair of chord elements toward one another by sliding them on the flat edges of web 106 until they abut stiffening ribs 106*a* of the web panels, thus correctly aligning all the principal parts of the beam.

After the components of the beam have been clamped and aligned as described, each pair of vertically aligned chord elements (consisting of one element 110 and one element 116) may then be nailed together by using nail-gun 122. Gun 122 can be held and moved by hand but is preferably supported and guided on rails located above the beam. A nail 124 is shown in place in FIG. 6B.

After nailing has been completed, the beam is trimmed to length by docking blade 126 which also cuts through web 106. If desired, a pair of shears for cutting the web by itself may be substituted for the docking blade and the web may be cut to length before the beam is assembled rather than after. As no provision is made in this apparatus for the attachment of studs or stud-plates to the ends of the beam, this will need to be done manually or in a press in a subsequent operation.

As will be noted from FIG. 6A, the upper and lower chord elements need not be continuous lengths of timber, so long as the butt-joins in them do not coincide. Little tensional force need be carried by the lower timber chord when the beam is in place with the tension-strip of the web at the bottom. Nevertheless, it is preferable to finger-joint the chord elements so that the tensional strength of the timber is added to that of the tension-strip of the steel web and the lateral stiffness of the beam is improved.

Figure 7:
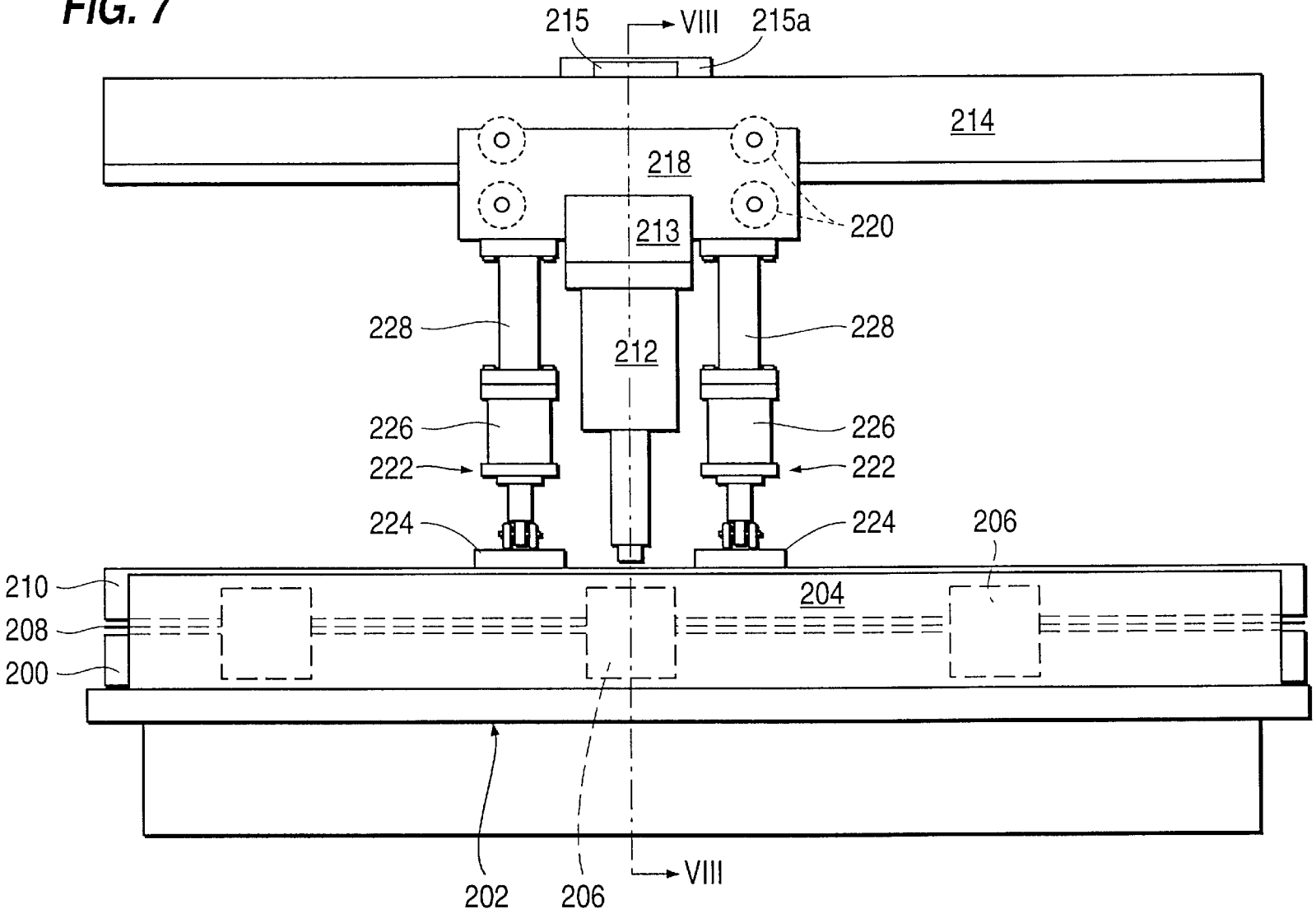
FIG. 7 is a diagrammatic side elevation of a beam-nailing apparatus.
Figure 8:
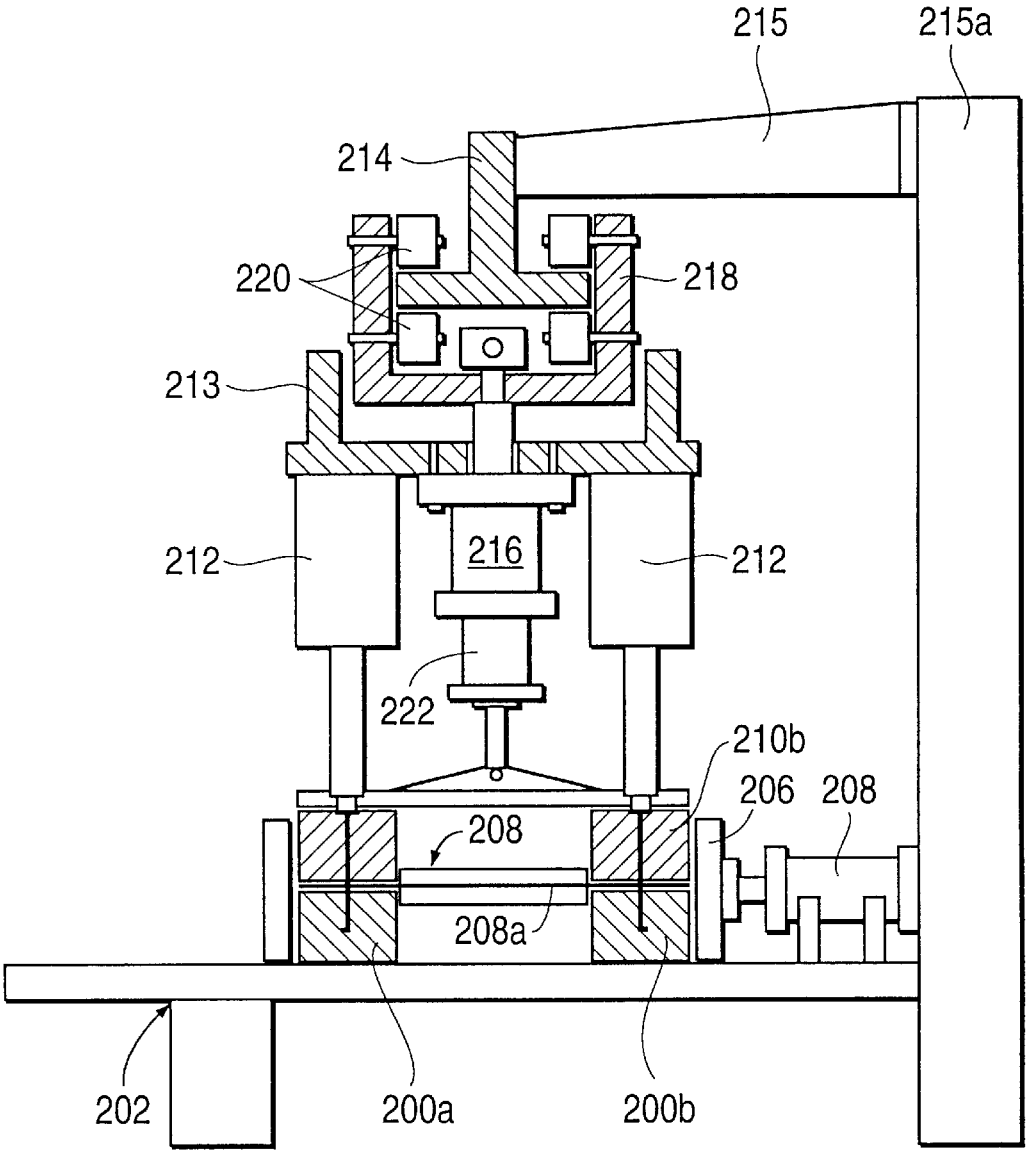
FIG. 8 is a cross-section taken along line VIII—VIII in FIG. 7.

A semi-automated apparatus for clamping the beam elements and nailing them together is diagrammatically illustrated in FIGS. 7A and 7B. Here, one pair of timber chord elements 200*a* and 200*b* is laid on a work-bench 202 so that front element 200*a* lies along the rear face of a vertical stop-plate 204 that is fixed to bench 202, and so that rear element 200*b* abuts with the front faces of a series of clamp-pads 206 that can be moved forward and rearwards by associated pneumatic actuators 208. At this stage, actuators 208 are set so that pads 206 are withdrawn to a fixed rear position. The web 208 for the beam is then laid on spaced elements 200*a* and 200*b* and a second pair of chord elements 210*a* and 210*b* is then laid on the web in similar positions to the first pair of elements 200*a* and 200*b*. Actuators 208 are then operated to bring all the chord elements and the web into correct alignment, but without using sufficient pressure to force the chord elements over the stiffening ribs 208*a* of web 208.

A pair of nail-guns 212 is suspended from an inverted-T rail 214 that is arranged above (and in alignment with) the approximate centre of the beam are laid-up, each gun being suspended directly over a chord of the beam. Rail 214 is in turn suspended from a series of cantilever arms 215 that are supported by posts 215*a*. Guns 212 themselves are mounted by their top faces to the lower face of a slider plate 214 that can be raised or lowered by a pneumatic actuator 216 with respect to a carriage 218 that is mounted by rollers 220 for sliding motion along rail 214. A vertically-operable clamp 222 is arranged on each side of the pair of guns 212 and comprises a foot-plate 224 pivotally attached to the lower end of a pneumatic actuator 226 that is, in turn, bolted to a pedestal 228 which is directly secured to the bottom face of carriage 218.

While the components of the beam on workbench 202 are being laid-up and lightly held horizontally in place by actuators 208 as described above, carriage 218, together with its various appendages, is located out of the way at one end of the beam. It is then driven stepwise along rail 214 so as to stop at each location where a pair nails is to be driven into the timber chord elements. When carriage 218 is to be moved, the guns are raised by actuator 216 and foot-plates 224 are released (raised) by actuators 226, and when the carriage is stopped ready for nailing to take place, clamps 222 are lowered onto timber elements 210 to position them vertically. If desired, the nearest horizontal clamp actuators 208 may be actuated to apply a final level of pressure to the chord elements. Actuator 216 is then operated to lower slider plate 214 so that the ends of guns 212 are brought into contact with chord elements 210 to automatically drive a pair of nails into the chords through web 208. The guns are then raised by actuator 216 and vertical clamps 222 are released by actuator 226 so that carriage 218 can be moved to the next nail position and the process repeated.

While a drive and control mechanism for the apparatus of FIGS. 7A and 7B have not been described, these can readily be constructed by those skilled in the art. It will also be appreciated by such persons that more than one nail-gun carriage may be employed over a single beam at one time. Similarly, it will be appreciated that the nail guns can be fixed while the un-nailed beam is drawn past them, rather than the reverse as described in the selected examples. Also, there is no need for the beam components to be laid-up with the web horizontal as the nail guns can be arranged to drive nails at any angle and, with appropriate jigs, the beam components can be laid up with the web vertical or at any convenient angle to the horizontal.

Finally, to assist in laying-up a beam for nailing, it is envisaged that a series of shallow spikes could be struck from the edges of the web at the time it is pressed. This will be of value where the beam is being laid-up on site and hand-nailed as it will assist the chord elements to be retained in place once they have been lightly pressed or hammered onto the edges of the web. On the other hand, such spikes will make the handling of the web more difficult and they will make the jig-based assembly of beams rather awkward.

It will be appreciated by those skilled in the art that composite beams of the type disclosed herein have considerable advantages in terms of cost and convenience with respect to all timber or all steel beams. It will also be appreciated that considerable savings and convenience are offered by permitting beams to be fabricated to order by truss-manufacturers, builders suppliers or even on-site by individual builders using common sections of timber which are ready to-hand.

Nevertheless, it will also be appreciated that many variations and additions can be made to the beams, webs, methods and apparatus disclosed herein without departing from the scope or spirit of this invention as set out in the following claims.

I claim:

1. A coilable, elongate sheet-metal web for use in the fabrication of structural I-beams which have a pair of top timber chord elements arranged one on each side of the top edge of the web and a pair of bottom timber chord elements arranged one on each side of the bottom edge of the web, the web comprising:

(a) a plurality of panels arranged in spaced coplanar relation with one another along the length of the web, each panel having substantially flat lengthwise-extending upper and lower faces on each side thereof adapted for interposition between the pairs of top and bottom timber chord elements, each panel also having a plurality of vertical stiffening ribs formed in the portion of the panel between said upper and lower faces so that at least one rib protrudes from each side of the panel and so that the bottoms of the ribs terminate at the top of said lower faces and the tops of the ribs terminate at the bottom of said upper faces, said ribs thereby being adapted to vertically locate the top timber chord elements of the beam with respect to the bottom timber chord elements of the beam employing the web, and (b) a continuous, substantially flat sheet metal tension-strip extending along the bottom edge of the web joining the panels together along their lower faces, thereby forming flexible sections between the panels so that the web may be coiled.

2. The web according to claim 1 having gaps between adjacent panels to form access spaces at intervals along the length of an I-beam fabricated from the web.

3. The web according to claim 2, wherein said tension-strip is formed integrally with the panels; a fillet is formed at the junction of each vertical side edge of each panel and the tension strip; and an indentation of a triangular shape is formed in each fillet to stiffen the fillet.

4. The web according to claim 3, wherein:

said tension strip is integral with the bottom faces of said panels; said gaps extend to the top edge of the web so that the web is of a castellated form;

the web is formed by pressing; another complementary interleaved castellated web is formed from a single strip of sheet metal; and the web is coiled together with said complementary interleaved castellated web.

5. The web according to claim 2, wherein each of said access spaces are generally circular.

6. The web according to claim 5, wherein said circular access spaces have a diameter approximately equal to a distance from the top timber chord elements to the bottom timber chord elements.

7. A structural I-beam comprising:

(a) a central sheet-metal web including a plurality of panels arranged in spaced coplanar relation with one another along the length of the web, each panel having substantially flat lengthwise-extending upper and lower faces on each side thereof, each panel also having a plurality of vertical stiffening ribs formed in the portion of the panel between said upper and lower faces so that at least one rib protrudes from each side of the panel and so that bottoms of the ribs terminate at the top of said lower faces and tops of the ribs terminate at the bottom of said upper faces, and a continuous, substantially flat sheet metal tension-strip extending along a bottom portion of the web and joining the panels together along their lower faces, thereby forming flexible sections between the panels so that the web may be coiled;

(b) an upper timber chord element on each side of the upper face of the web, each upper element being transversely located by the tops of the ribs of the panels of the webs;

(c) a lower timber chord element on each side of the lower face of the web, each lower element being transversely located by the bottoms of the ribs of the panels of the webs;

(d) nails driven through the upper elements and the upper face of the web securing the upper elements and the web together; and (e) nails driven through the lower elements and the lower face of the web securing the lower elements and the web together.

8. A structural I-beam comprising:

(a) a central sheet-metal web including a plurality of panels arranged in spaced coplanar relation with one another along the length of the web, each panel having substantially flat lengthwise-extending upper and lower faces on each side thereof, each panel also having a plurality of vertical stiffening ribs formed in the portion of the panel between said upper and lower faces so that at least one rib protrudes from each side of the panel and so that bottoms of the ribs terminate at the top of said lower faces and tops of the ribs terminate at the bottom of said upper faces, and a continuous, substantially flat sheet metal tension-strip extending along a bottom portion of the web and joining the panels together along their lower faces, thereby forming flexible sections between the panels so that the web may be coiled;

(b) an upper timber chord element including a longitudinal slot accommodating the upper faces of the web, the upper element being transversely located by the tops of the ribs of the panels of the webs;

(c) a lower timber chord element including a longitudinal slot accommodating the lower faces of the web, the lower element being transversely located by the bottoms of the ribs of the panels of the webs;

(d) nails driven through the upper element and the upper faces of the web securing the upper element and the web together; and (e) nails driven through the lower element and the lower faces of the web securing the lower element and the web together.

* * * * *